US005762228A

United States Patent [19]

Morgan et al.

[11] Patent Number: 5,762,228

[45] Date of Patent: Jun. 9, 1998

[54] VENTED SEAL WITH ROCKING VENT COVER

[75] Inventors: William K. Morgan; D. Scott Miller, both of Orlando, Fla.

[73] Assignee: Dart Industries Inc., Orlando, Fla.

[21] Appl. No.: 687,871

[22] Filed: Jul. 26, 1996

[51] Int. Cl.[6] ..... B65D 51/00

[52] U.S. Cl. ..... 220/367.1; 16/257; 220/254; 220/334; 220/338; 220/796

[58] Field of Search ..... 215/307, 354, 215/310, 355; 220/337, 334, 338, 343, 254, 367.1, 780, 798, 789, 796; 16/257; 222/517

[56] References Cited

U.S. PATENT DOCUMENTS

| | | | |
|---|---|---|---|
| D. 60,181 | 1/1922 | Totten . | |
| D. 254,355 | 3/1980 | Ottier . | |
| D. 329,572 | 9/1992 | Krupa . | |
| D. 343,338 | 1/1994 | Bucher et al. . | |
| D. 348,805 | 7/1994 | Cautereels . | |
| D. 349,005 | 7/1994 | Cousins et al. . | |
| D. 352,423 | 11/1994 | Laib . | |
| 1,520,845 | 12/1924 | Baker . | |
| 2,111,186 | 3/1938 | Jenks . | |
| 2,754,866 | 7/1956 | Coltman, Jr. | 220/254 X |
| 2,764,199 | 9/1956 | Tupper | 220/254 |
| 2,764,200 | 9/1956 | Gits | 220/254 |
| 2,790,475 | 4/1957 | Close | 220/254 |
| 3,113,692 | 12/1963 | Di Pierro | 220/338 |
| 3,297,192 | 1/1967 | Swett | 220/338 |
| 3,361,289 | 1/1968 | Mattson | 220/338 |
| 3,898,046 | 8/1975 | Ikeda et al. | 215/355 X |
| 3,902,628 | 9/1975 | Schurman . | |
| 3,917,131 | 11/1975 | Levin . | |
| 3,952,911 | 4/1976 | Bozek et al. . | |
| 4,148,411 | 4/1979 | Hodge et al. . | |
| 4,607,768 | 8/1986 | Taber et al. . | |
| 4,632,266 | 12/1986 | Osswald | 220/338 X |
| 4,821,899 | 4/1989 | Nycz et al. . | |
| 4,850,081 | 7/1989 | Grant | 16/257 |
| 4,883,641 | 11/1989 | Wicks et al. | 215/355 X |
| 4,887,747 | 12/1989 | Ostrowsky et al. | 220/338 X |
| 4,893,724 | 1/1990 | Schiemann . | |
| 4,942,271 | 7/1990 | Corsi et al. | 220/338 X |
| 4,962,869 | 10/1990 | Gross et al. . | |
| 4,967,924 | 11/1990 | Murofushi et al. | 220/338 X |
| 5,065,912 | 11/1991 | Rosenthal . | |
| 5,186,349 | 2/1993 | Sakamoto . | |
| 5,203,467 | 4/1993 | Tucker . | |
| 5,244,113 | 9/1993 | Stymiest . | |
| 5,248,056 | 9/1993 | Shaw . | |
| 5,305,900 | 4/1994 | Maguire et al. . | |
| 5,354,539 | 10/1994 | Hovatter . | |
| 5,363,978 | 11/1994 | Molo . | |
| 5,503,309 | 4/1996 | Order et al. . | |

*Primary Examiner*—Allan N. Shoap
*Assistant Examiner*—Robin A. Hylton
*Attorney, Agent, or Firm*—John A. Doninger; Taylor J. Ross

[57] ABSTRACT

A vent assembly for the top panel of a seal for a food container including a vent hole in the seal panel at least partially surrounded by an upwardly opening recess with the vent hole and recess being below the upper surface of the seal panel. A vent cover, including a depending plug selectively receivable in the vent hole, is pivotally mounted by a hinge assembly which included a hinge pin on said cover received within spaced trunnion openings in the recess adjacent the vent hole. The trunnion openings are laterally enlarged relative to the pin diameter and of a generally non-symmetric oval configuration.

13 Claims, 3 Drawing Sheets

VENTED SEAL WITH ROCKING VENT COVER

BACKGROUND OF THE INVENTION

Food storage containers, conventionally of an appropriate plastic or synthetic resinous material such as polypropylene, are frequently subjected to extreme cold as when storing foodstuff within a freezer, and are just as frequently subjected to high heat conditions during the heating of foodstuffs within a microwave oven.

In order to relieve internal pressure build-ups, particularly during heating, the container is normally vented, either by a partial removal of the seal or through the provision of a vent either in the container or in the seal itself. As an example of a vented seal, attention is directed to U.S. Pat. No. 5,363,978, commonly assigned with the present application.

In most containers intended to contain foodstuff throughout both the freezing and subsequent heating thereof, thus subjecting the container to two temperature extremes, differential expansion and contraction will occur between the various components of the container. While this will normally be no problem between the seal and the container itself, a problem will arise in those instances wherein a vent hole is provided in the seal and a separate cover for the vent hole is mounted to the seal for pivotal movement selectively opening and closing the vent hole. With such an arrangement, and when subjected to the temperature extremes of a freezing and heating, there is a tendency for the vent cover to dislodge from the vent opening or possibly break between the remotely secured hinge means and plug portion. In those instances where the cover is open, and it is desired to close the cover while the container is subjected to either temperature extreme, the differential expansion or contraction will tend to misalign the sealing element of the cover, for example a plug, and the vent opening. As it is frequently desirable to open or close the vent at temperature extremes, this could lead to substantial difficulties.

SUMMARY OF THE INVENTION

The present invention is concerned with improvements in vented seals for storage containers for foodstuffs and the like wherein such containers are particularly adapted for use under extreme temperature conditions. For example, modern food containers of appropriate synthetic resins are frequently used to store foods in a home freezer and are subsequently taken directly therefrom and introduced into a microwave oven.

The provision of the vent, integrally formed within the top panel of the seal and capable of accommodating pressure changes within the container, particularly at extreme temperature ranges, avoids the necessity of disrupting the seal by a partial opening or removal thereof. This in turn allows for a rather secure mounting of the seal peripherally about the container and in a manner which, through the inherent resiliency of the seal and container, maintains a secure relationship until manually removed.

The vent is recessed within the top panel of the seal. In order to control the opening and closing of the vent hole, a vent cover is provided in overlying relation thereto, with the vent cover, when closed, lying within the plane of the seal top panel to present a substantially flush continuous upper surface, allowing for convenient storing, stacking, and the like. Notwithstanding this flush positioning of the vent cover, the cover is easily manipulated through a convenient rocking action allowing for a cover-mounted plug to selectively engage and release from the vent hole.

The vent cover, in order to accommodate such a rocking movement, is normally of a relatively rigid material with less tendency to flex than the seal or container base. As such, under temperature extremes, there is a tendency for differential expansion and contraction between the vent cover and the vent hole or vent structure other than for the cover which is defined integrally from the top panel of the seal. It is a particular intent of the present invention to provide for an accommodation of this differential expansion and contraction to facilitate manipulation of the vent cover, that is the opening and closing thereof, and to more specifically avoid development of any undue stresses between the cover and vent hole or disruption of the cover when the cover is in the closed position. In other words, by accommodating, as an example, differential shrinking or contraction of the materials as a filled container is subjected to freezing, the hole plug on the cover will maintain its seal.

More specifically, the vent hole is provided within a recess in the seal panel to one side of an approximate center line of the recess defined by a pair of spaced aligned trunnions. The cover on a transverse or diametric central line, includes an integral depending projection which, along the lower edge thereof, mounts an elongate shaft or hinge pin, the end portions of which extend longitudinally beyond the projection and downwardly snap into the two trunnions for free rotation therein. The end portions of the shaft are cylindrical, while the trunnion openings which receive these portions are elongate transversely relative to the mounted shaft portions, that is generally parallel to the vent cover in the closed position thereof. So provided, the vent cover can self adjust toward and away from the vent opening to accommodate differential expansion and contraction between the cover, the top panel of the seal and the vent components formed therefrom to ensure a proper non-stressed engagement and retention of the plug within the vent opening. Similarly, the free rotational reception of the shaft end portions within the trunnion openings also allows for a slight longitudinal adjustment of the shaft within the trunnions to further accommodate differential expansion and contraction. A shaft supporting cradle is integrally formed with the recess bottom and extends between the trunnions for stabilizing the shaft in the normal position, that is when there is no or minimal differential expansion and contraction.

Other features, details and advantages of the invention will become apparent as the invention is more fully hereinafter set forth.

DESCRIPTION OF PREFERRED EMBODIMENT

Figure 1:
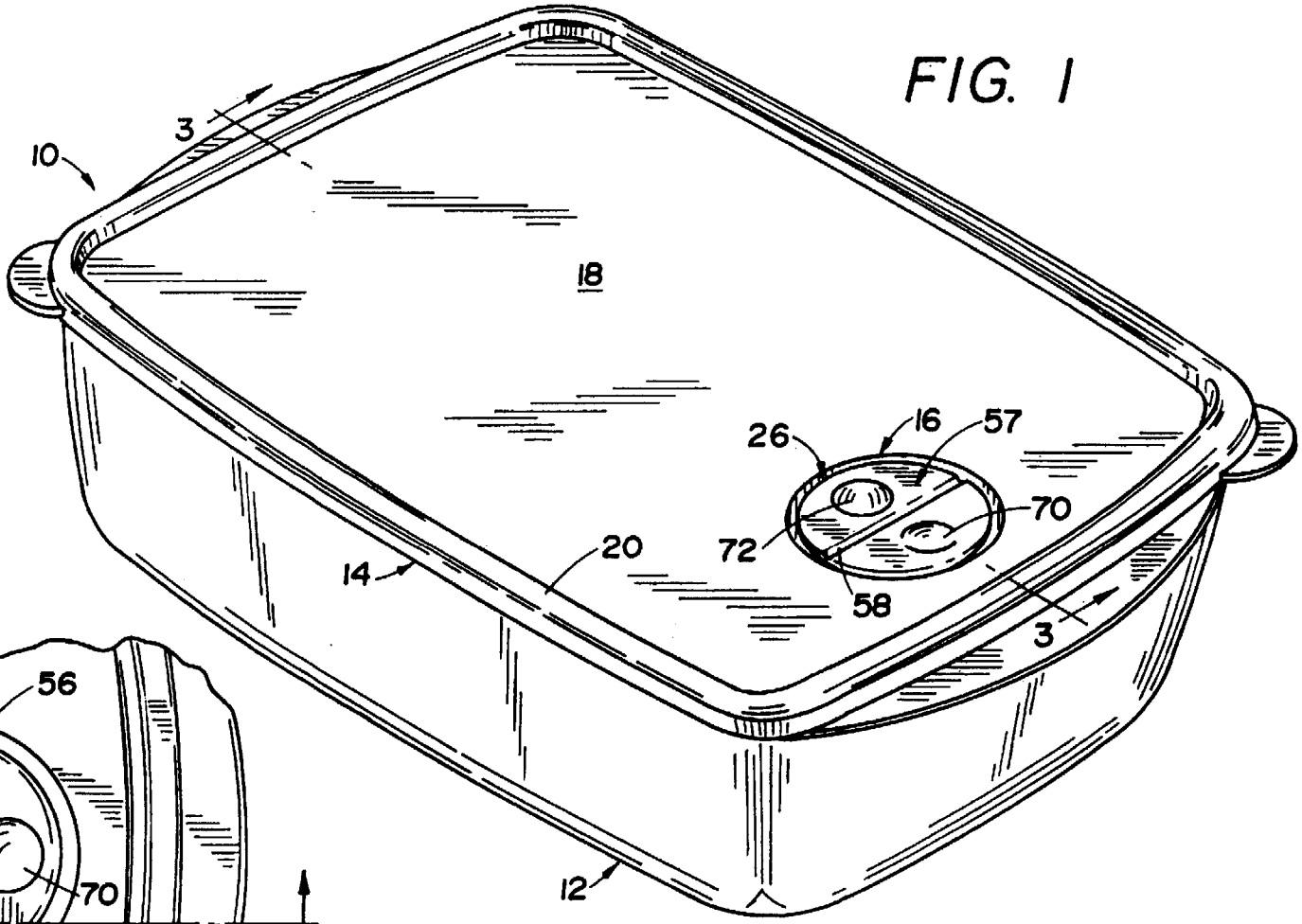
FIG. 1 is a perspective view of the storage container including a seal with the vent assembly of the invention incorporated therein.
Figure 2:
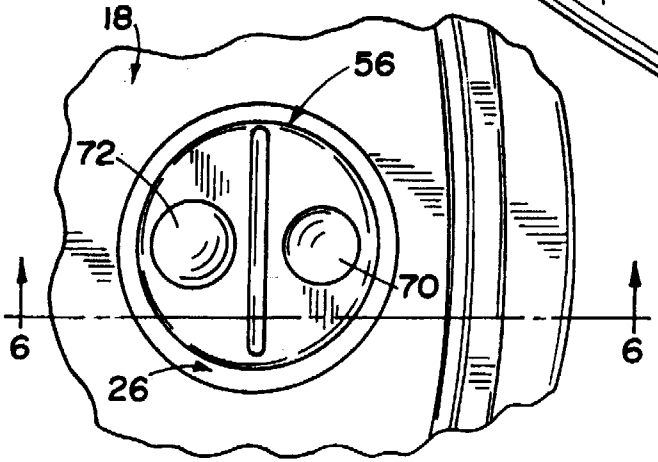
FIG. 2 is a partial top plan view illustrating the vent assembly and adjacent portions of the seal.

Referring now more specifically to the drawings, FIG. 1 illustrates a storage container 10 including a base 12, a seal 14 and a vent assembly 16, all of which are of appropriate food-compatible and microwavable plastic or synthetic resinous materials.

The seal and base, for purposes of illustration, have been shown as substantially rectangular. As is conventional, the peripheral configuration of the seal 14 conforms to the shape of the mouth of the base 12. The seal 14 includes a base-covering top panel 18 with an integral peripheral mounting flange 20 which is, in a usual manner, releasably snap-locked to the upper rim of the base 12 in intimate contact therewith peripherally about the mouth of the base. The top panel 18 of the seal has a planar or substantially planar upper or outer face 22 to enable a convenience stacking of multiple storage containers 10, and a similar planar or substantially planar lower or inner face 24.

As the container is intended for use under a wide range of temperature conditions, from use as a freezer container to use in the heating of foodstuffs in a microwave oven or the like, the vent assembly 16, and its ability to accommodate temperature extremes, is of particular significance. The vent assembly 16 comprises an upwardly opening depression or recess 26, preferably annular as illustrated, formed in the panel 18 preferably toward one end of the seal and generally on the center line of the storage container. The recess 26 is formed entirely below the planar outer face 22 of the panel 18 and includes a sloping bottom 28 transversely or diametrically divided by an integral elongate hinge component 30 extending upward from the bottom 28. The hinge component 30, to be described in more detail subsequently, divides the recess 26 into two opposed substantially equal sections, a first section 32 and a second section 34.

A substantially conical upwardly directed hollow stem 36 is integrally formed with the bottom 28 in the first section 32 of the recess 26 and terminates in a truncated upper end defining a vent opening or hole 38 which provides direct communication through the seal panel 18. The hole 38 is provided with a peripheral inwardly directed locking lip, with the hole and hence the upper end of the stem 36, being below or inward of the plane of the upper face 22 of the panel 18.

The hinge component 30 integral with the bottom 28 of the recess 26 includes a pair of longitudinally spaced trunnions 40, each formed by a pair of opposed trunnion sectors 42 and 44. The sectors 42, one on each trunnion 40, each includes an arcuate seat 46, following the arc of a circle or cylinder and laterally inwardly directed toward the companion trunnion sector 44. Each trunnion sector 44, in turn, includes a laterally inwardly directed concave seat 48 having a lower portion aligned with and laterally spaced from the lower portion of the companion seat 46 to define an arcuate continuation therewith. The seat 48, also arcuate, is defined on a greater radius or arc than the seat 46 and extends to a height above that of the seat 46 with the associated trunnion sector 44 similarly extending above the companion sector 42. The opposed seats 46 and 48 of each trunnion define a laterally elongate trunnion opening 50, the transverse shape of which is generally oval and more specifically of a non-symmetric configuration having an eccentric longitudinal axis. The upper portions of the opposed sectors 42 and 44 of each trunnion, provide a restricted access mouth 52 to the trunnion opening which, because of the height differential between the sectors, is in a plane at an angle to the vertical center line between the sectors.

The longitudinally spaced trunnions 40 are interconnected by an integral elongate cradle 54 which has a full length concave upper surface conforming to the arc of the lower portion of the opening 50 defined by the lower portions of the opposed seats 46 and 48 and is of equal height therewith.

The vent assembly 16 further includes a vent cover 56 forming a substantially planar top or outer member 57 which substantially conforms to the configuration of the open end of the recess 26 and is slightly smaller to enable a vertical rocking movement of the cover 56 within and relative to the recess as shall be explained subsequently. The cover 56, similar to the recess 26, is centrally or diametrically divided, as preferably indicated by an appropriate groove or indicia 58 appearing in the upper surface thereof.

Parallel with center line 58 and in spaced relation to the undersurface of the cover member 57 is an elongate, cylindrical pivot shaft or pin 60, the central portion of which is integrally joined to the cover undersurface by projection or block 62, thereby defining the second component of the hinge assembly.

Figure 6:
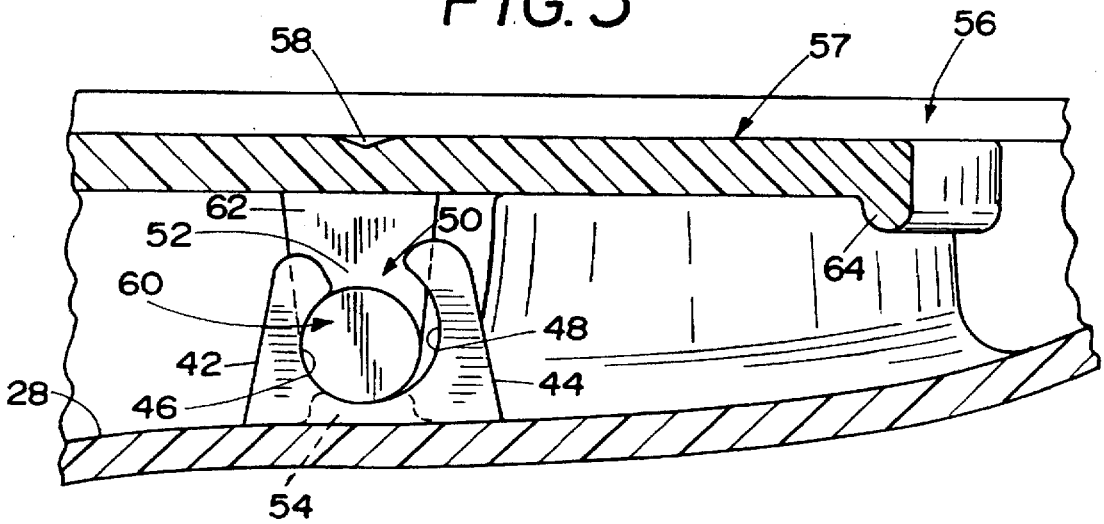
FIG. 6 is an enlarged cross-sectional detail illustrating the rocking mounting of the cover and taken substantially on a plane passing along line 6—6 in FIG. 2.

The opposed ends or end portions 64 of the hinge shaft or pin 60 are engaged with the opposed trunnions 40 by snap introduction of these end portions through the trunnion mouth 52 and into the opening 50. The shaft end portions are cylindrical and conform to the seats 46 within the trunnions 42 and are rotatable relative thereto. The intermediate portion of the shaft 60 rotatably seats on the cradle 54 between the trunnions. Noting FIG. 6 in particular, with the shaft 60 fully seated within the trunnions, and confined by the restricted trunnion mouth 52 defined by the upper ends of the trunnion sectors 42 and 44, the cover 56 is mounted for free rocking engagement with the shaft normally seating on the concave upper surface of the cradle 54 and within the smaller seat 46. The larger seat 48, in turn, is positioned as to define a definite space forward of the shaft end portions toward the vent hole 38. It would also be recognized that the shaft 60, upon forward movement toward the larger seat 48, can in fact adjust or move upward relative to the bottom of the recess until restricted by the restricted mouth 52 defined by the upper end portions of the trunnion sectors, thus allowing for substantial but confined adjustment.

Figure 3:
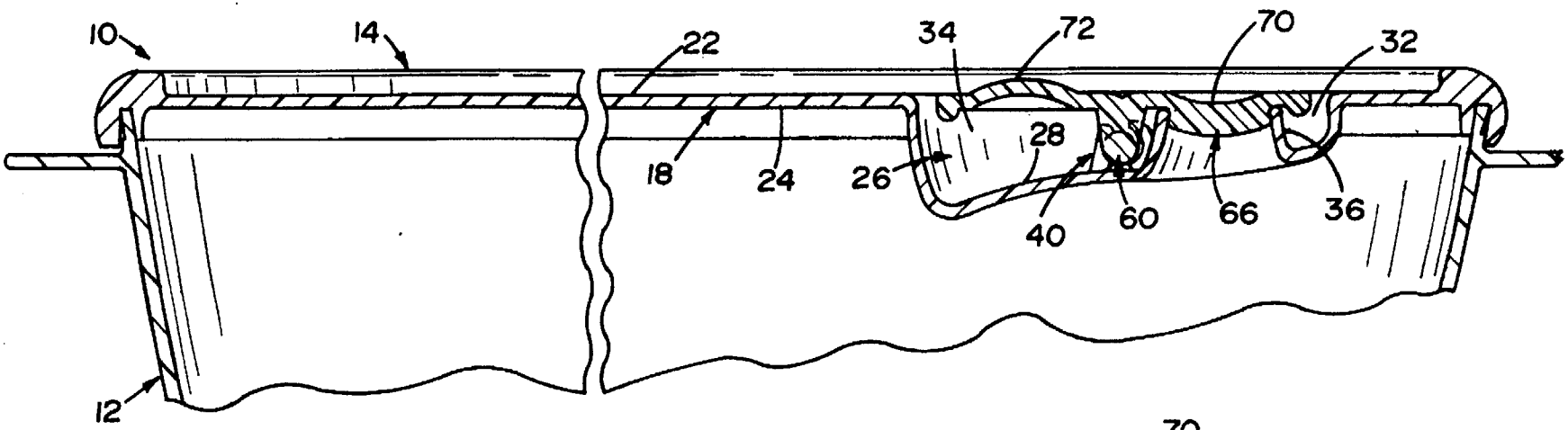
FIG. 3 is an enlarged cross-sectional view taken substantially on a plane passing along line 3–3 in FIG. 1 and illustrating the vent assembly with the cover closed.

The cover member 57 is peripherally rigidified by a depending integral edge portion 64. That section of the cover 56 which overlies the first or vent section of the recess 26 includes a depending integrally formed plug 66 having, peripherally about the lower end thereof, a sealing bead or lip 68. In the closed position of the cover, the cover outer member 57 is, as in FIG. 3, substantially in the plane of the seal panel 18 to maintain a planar stacking surface. So positioned, the closing plug 66 is intimately and sealingly engaged within and through the vent hole 38 with the plug peripheral bead 68 snap-locked and engaged immediately below the peripheral lip surrounding the vent hole 38. So positioned, the peripheral edge of the vent hole 38 seals against the undersurface of the top member of the cover, with the upper surface of the cover, immediately over the plug 66, having a slight depression 70 therein to provide an indication as to the point at which pressure is to be applied to firmly engage the plug.

Figure 4:
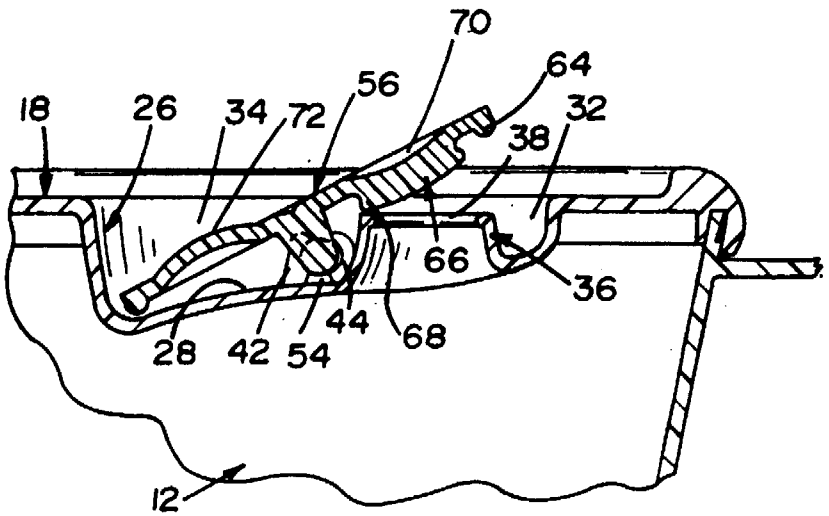
FIG. 4 is a partial cross-sectional view similar to FIG. 3 wherein the vent cover is in its open position.
Figure 5:
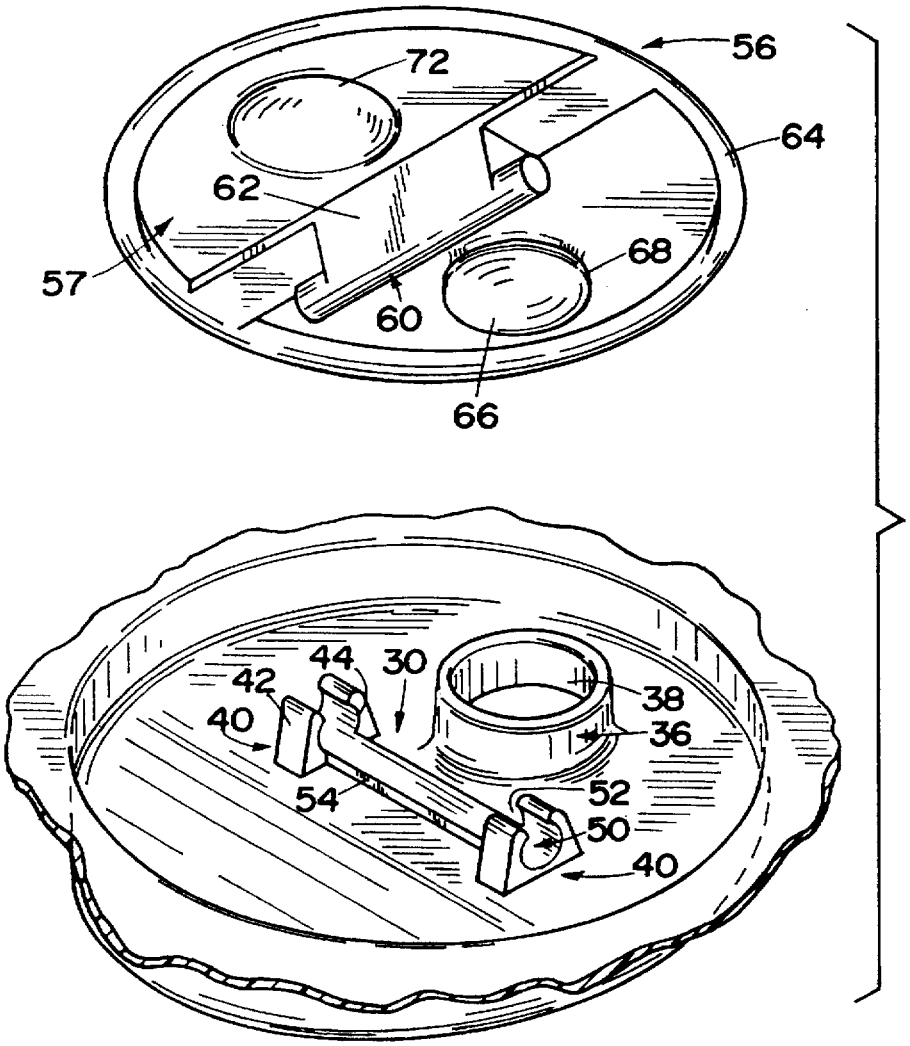
FIG. 5 is a perspective view of the vent assembly with vent cover exploded.

The second section of the vent cover 56, that is that section to the other side of the hinge assembly, overlies the relatively deeper section 34 of the recess 26 defined by the sloping bottom 28 of the recess, and includes a slight integral dome 72 formed therein and indicating the desired point for the application of pressure to upwardly rock the sealing plug 66 to open the vent hole 38, as best seen in FIG. 4.

Inasmuch as the storage container 10 is intended for use under extreme temperature conditions, there will of necessity be some degree of differential expansion and contraction, particularly between the seal and vent assembly portions integrally formed therewith, and the vent cover which, to achieve the proper locking action, may be of a more rigid nature. In order to accommodate this, and to ensure a continuous and proper action of the vent cover when both sealing and opening, the invention provides a hinge assembly which allows for a self-centering of the plug, even when subjected to differential expansion as by heating, and differential contraction by freezing. In this manner, the storage container of the invention retains all of the desirable features of a conventional storage container, while at the same time enhancing the versatility of such containers by accommodating the container for use under all commonly encountered temperature extremes. As the seal will not normally be closed or opened at the temperature extremes, and in light of the large areas involved and the corresponding lack of any appreciable differential expansion and contraction between the seal and base, the seal between the seal and base, contrary to that between the vent hole and vent cover, is easily maintained under temperature extremes.

The foregoing is illustrative of the features of the invention. As other possible variations of the preferred illustrated embodiment may occur to those skilled in the art, it is to be appreciated that the scope of the invention is to be limited only by the claims following hereinafter.

We claim:

1. A vent assembly for a storage container, said container including a seal, said seal having a portion thereof defining a substantially planar panel, said panel having an outer face and an inner face; said vent assembly including an integral portion of said panel depressed inwardly relative to said outer face and defining an outwardly opening recess, said recess having a bottom, a first hinge component on said recess bottom extending across a substantial portion thereof and defining first and second generally equal size sections in said recess to opposite sides of said first hinge component, a vent hole defined through said bottom in said first section, a vent cover overlying said recess and including a depending vent plug selectively engaged within and closing said vent hole in a closed position of said vent cover, said vent cover in said closed position, being in a substantially common plane with said panel about said recess, said vent cover including a depending second hinge component engaged with said first hinge component for relative rotation of said cover between said closed position wherein the vent plug is received within the vent hole, and an open position wherein the vent plug is outwardly retracted from said vent hole, said first and second hinge components, in said closed position of said vent cover, being laterally moveable relative to each other and selectively toward and away from said vent hole, while maintaining an engaged relationship of said vent plug with said vent hole, wherein differential expansion and contraction between said cover and said panel is accommodated with the plug maintained within the vent hole and the cover maintained generally coplanar with the panel surrounding the recess, said first hinge component comprising a trunnion structure, said second hinge component comprising a cylindrical hinge pin of predetermined diameter, openings defined by said trunnion structure for rotatable reception of said hinge pin, said openings, in transverse section, being elongate and allowing for lateral adjustment of said hinge pin within said openings in response to both differential expansion and differential contraction of said cover relative to said panel, said trunnion structure comprises two spaced trunnions, said openings comprising a pair of duplicate openings, one in each of said trunnions, each trunnion including two laterally spaced sectors, each sector having an arcuate seat therein, the two seats of each trunnion being inwardly directed toward each other and defining the corresponding opening, the seats of each trunnion sector are of different arcs and form a smaller seat closely conforming to and rotatably receiving the hinge pin, and a larger seat which allows for relative movement between the hinge pin and the openings.

2. The vent assembly of claim 1, including a cradle portion integral with and extending longitudinally between said trunnions, said cradle portion having an outwardly directed transversely concave outer surface therein defining a general continuation of the smaller seat and rotatably receiving said hinge pin therein.

3. The vent assembly of claim 2, wherein said trunnion sectors of each trunnion include laterally spaced upper end portions defining a trunnion mouth of slightly less width than said predetermined diameter of said hinge pin for snap-mounting of said hinge pin within said trunnion openings.

4. The vent assembly of claims 3, wherein said vent cover includes a substantially planar outer member generally coextensive with said recess and freely moveable therein about said hinge components, said vent cover outer member being divided into a sealing section mounting said vent plug over said vent hole, and a manipulating section positioned over said recess to the opposite side of said hinge components from said vent hole wherein inward pressure on said manipulating section provides, through said hinge components, a corresponding outward movement of said sealing section and said plug out of engagement with said vent hole and wherein inward pressure on said sealing section engages said vent plug in said vent hole and moves said vent cover outer member into substantially the plane of said seal panel.

5. The vent assembly of claim 4, including an integral, outwardly directed, hollow conical portion in said first section of said recess terminating in an open truncated upper end defining said vent hole and means on said vent hole and said vent plug for releasably locking said vent plug in said vent hole.

6. The vent assembly of claim 5, wherein the trunnion sector of each trunnion having the larger seat is of a greater height than the companion sector of the trunnion, the trunnion mouth being oriented in a plane at an angle to a vertical center line between said trunnion sectors.

7. A vent assembly for a storage container, said container including a seal, said seal having a portion thereof defining a substantially planar panel, said panel having an outer face and an inner face;

said vent assembly including an integral portion of said panel depressed inwardly relative to said outer face and defining an outwardly opening recess, said recess having a bottom, a first hinge component on said recess bottom extending across a substantial portion thereof and defining first and second generally equal size sections in said recess to opposite sides of said first hinge component, a vent hole defined through said bottom in said first section, a vent cover overlying said recess and including a depending vent plug selectively engaged within and closing said vent hole in a closed position of said vent cover, said vent cover in said closed position, being in a substantially common plane with said panel about said recess, said vent cover including a depending second hinge component engaged with said first hinge component for relative rotation of said cover between said closed position wherein the vent plug is received within the vent hole, and an open Position wherein the vent plug is outwardly retracted from said vent hole, said first and second hinge components, in said closed position of said vent cover, being laterally moveable relative to each other and selectively toward and away from said vent hole, while maintaining an engaged relationship of said vent plug with said vent hole, wherein differential expansion and contraction between said cover and said panel is accommodated with the plug maintained within the vent hole and the cover maintained generally coplanar with the panel surrounding the recess, said first hinge component comprising a trunnion structure, said second hinge component comprising a cylindrical hinge pin of predetermined diameter, openings defined by said trunnion structure for rotatable reception of said hinge pin, said openings, in transverse section, being elongate and allowing for lateral adjustment of said hinge Pin within said openings, in response to differential expansion and/or contraction of said cover relative to said panel, said trunnion structure comprises two spaced trunnions, said openings comprising a pair of duplicate openings, one in each of said trunnions, and a cradle portion integral with and extending longitudinally between said trunnions, said cradle portion having an outwardly directed transversely concave outer surface therein and rotatably receiving said hinge pin therein. pg,19

8. A vent assembly for a storage container, said container including a seal, said seal having a portion thereof defining a substantially planar panel, said panel having an outer face and an inner face; said vent assembly including an integral portion of said panel depressed inwardly relative to said outer face and defining an outwardly opening recess, said recess having a bottom, a first hinge component on said recess bottom extending across a substantial portion thereof and defining first and second generally equal size sections in said recess to opposite sides of said first hinge component, a vent hole defined through said bottom in said first section, a vent cover overlying said recess and including a depending vent hole sealing element selectively closing said vent hole in a closed position of said vent cover, said vent cover in said closed position, being in a substantially common plane with said panel about said recess, said vent cover including a depending second hinge component engaged with said first hinge component for relative rotation of said cover between said closed position wherein the vent hole sealing element closes the vent hole, and an open position wherein the vent hole sealing element is outwardly retracted from said vent hole, one of said first and second hinge components comprising a trunnion, another of said first and second hinge components comprising a hinge pin, said trunnion defining an opening for rotational reception of said hinge pin, said opening, in transverse section, being elongate with transversely opposed seats inwardly directed toward each other and forming a smaller seat rotatable receiving said hinge pin and a larger seat allowing for lateral adjustment of said hinge pin within said opening in said closed position of said vent cover, wherein differential expansion and contraction between said cover and said panel is accommodated with the vent hole sealing element closing the vent hole and the cover maintained generally coplanar with the panel surrounding the recess, said vent cover including a substantially planar outer member generally coextensive with said recess and freely moveable therein about said hinge components, said vent cover outer member being divided into a sealing section and a manipulating section, said sealing section mounting said vent hole sealing element over said vent hole, said manipulating section being positioned over said recess to the opposite side of said hinge components from said vent hole wherein inward pressure on said manipulating section provides, through said hinge components, a corresponding outward movement of said sealing section and said vent hole sealing element out of engagement with said vent hole and wherein inward pressure on said sealing section moves said vent hole sealing element to close said vent hole and moves said vent cover top member into substantially the plane of said seal panel.

9. The vent assembly of claim 8, including an integral outwardly directed, hollow conical portion in said first section of said recess terminating in an open truncated upper end defining said vent hole and means on said vent hole and said vent plug for releasably locking said vent plug in said vent hole.

10. A vent assembly for a storage container, said container including a seal, said seal having a portion thereof defining a panel, said panel having an outer face and an inner face; said vent assembly including an integral portion of said panel depressed inwardly relative to said outer face and defining an outwardly opening recess, said recess having a bottom, a first hinge component on said recess bottom extending across a portion thereof and defining first and second sections in said recess to opposite sides of said first hinge component, a vent hole defined through said bottom in said first section, a vent cover overlying said recess and including a depending vent plug selectively engaged within and closing said vent hole in a closed position of said vent cover, said vent cover in said closed position, being in a substantial alignment with said panel about said recess, said vent cover including a second hinge component engaged with said first hinge component for relative rotation of said cover between said closed position wherein the vent plug is received within the vent hole, and an open position wherein the vent plug is outwardly retracted from said vent hole, said first and second hinge components, in said closed position of said vent cover, being laterally moveable relative to each other and selectively toward and away from said vent hole, while maintaining an engaged relationship of said vent plug with said vent hole, wherein differential expansion and contraction between said cover and said panel is accommodated with the plug maintained within the vent hole and the cover maintained in substantial alignment with the panel surrounding the recess, said first hinge component comprising a trunnion structure, said second hinge component comprising a hinge pin of predetermined diameter, said trunnion structure including a trunnion, said trunnion forming an opening for rotatable reception of said hinge pin, said opening, in transverse section, being elongate and allowing for lateral adjustment of said hinge pin within said opening in response to differential expansion and contraction of said cover relative to said panel, said trunnion including two laterally spaced sectors, each sector having an arcuate seat therein, the two seats of said trunnion being inwardly directed toward each other and defining the opening, the seats of said trunnion sectors being of different arcs and forming a smaller seat closely conforming to and rotatably receiving the hinge pin, and a larger seat which allows for relative movement between the hinge pin and the opening.

11. The vent assembly of claim 10, wherein said trunnion structure includes a second trunnion in spaced alignment with the first trunnion and including two laterally spaced sectors, each having an arcuate seat therein, the two seats of said second trunnion being inwardly directed toward each other and defining a second opening duplicating the opening formed by the first trunnion, said seats of said second trunnion being of different arcs from each other and forming a smaller seat closely conforming to and rotatably receiving the hinge pin, and a larger seat which allows for relative movement between the hinge pin and the second opening.

12. The vent assembly of claim 11, including a cradle portion integral with and extending longitudinally between the trunnions, said cradle portion having an outwardly directed transversely concave outer surface therein defining a general continuation of the smaller seat of each trunnion and rotatably receiving said hinge pin therein.

13. The vent assembly of claim 10 wherein said trunnion structure includes a second trunnion in spaced alignment with said first trunnion, said second trunnion forming an opening duplicating the opening formed by the first trunnion, and a cradle portion integral with and extending longitudinally between said trunnions, said cradle portion having an outwardly directed transverse concave outer surface rotatably receiving and supporting said hinge pin therein.

* * * * *